US012740635B2

(12) United States Patent
Williams

(10) Patent No.: US 12,740,635 B2
(45) Date of Patent: Sep. 22, 2026

(54) PACK-BASED HOLDER FOR BOTTLE OR OTHER ELONGATE OBJECT

(71) Applicant: Robert Williams, Edwards, CO (US)

(72) Inventor: Robert Williams, Edwards, CO (US)

( * ) Notice: Subject to any disclaimer, the term of this patent is extended or adjusted under 35 U.S.C. 154(b) by 243 days.

(21) Appl. No.: 18/473,731

(22) Filed: Sep. 25, 2023

(65) Prior Publication Data

US 2025/0098840 A1 Mar. 27, 2025

(51) Int. Cl.

*A45F 3/04* (2006.01)
*A45F 3/00* (2006.01)
*A45F 5/00* (2006.01)

(52) U.S. Cl.

CPC ..... *A45F 3/04* (2013.01); *A45F 2003/001* (2013.01); *A45F 5/1583* (2025.01)

(58) Field of Classification Search

CPC ..... A45F 3/04
USPC ..... 224/148.4, 148.5, 148.6, 148.7
See application file for complete search history.

(56) References Cited

U.S. PATENT DOCUMENTS 289,586 A 12/1883 Wanner
615,460 A 12/1898 Parker
816,317 A 3/1906 Hammarlund
898,222 A 9/1908 Johnson
1,165,840 A * 12/1915 Brutus ..... A62C 13/78 211/74
2,399,904 A * 5/1946 Baucum ..... F42B 39/02 224/931
2,532,244 A * 11/1950 William ..... B67B 7/28 248/311.2
2,754,078 A * 7/1956 Koger ..... B60N 3/102 248/291.1
3,224,644 A * 12/1965 William ..... B65D 83/267 222/162
4,050,584 A 9/1977 Lino
D279,836 S * 7/1985 Tanaka ..... D12/420
4,570,835 A * 2/1986 Criqui ..... B62J 11/04 224/446
4,767,092 A * 8/1988 Weatherly ..... A47K 1/08 248/214
4,848,625 A * 7/1989 Lucia ..... B62J 11/00 D7/619.1
4,951,910 A * 8/1990 March ..... B60N 3/106 248/205.2
4,997,157 A * 3/1991 Sweeny ..... A62C 13/78 D34/6
5,003,725 A * 4/1991 Maddox ..... A01G 5/04 248/312.1

(Continued)

FOREIGN PATENT DOCUMENTS

DE 200 06 781 U1 8/2000

*Primary Examiner* — Nathan J Newhouse
*Assistant Examiner* — Lester L Vanterpool
(74) *Attorney, Agent, or Firm* — Kilpatrick Townsend & Stockton LLP

(57) ABSTRACT

A pack-based holder includes a spine, a collar, and an arm. The collar can be attached to the spine and arranged to reduce movement of an object placed therein in a direction away from the longitudinal axis of the spine. The arm can be movably coupled to the spine and can move between an open position and a closed position. The arm can restrain gravitational movement of the object in the closed position, and in the open position, the arm does not restrain gravitational movement of the object.

20 Claims, 7 Drawing Sheets

(56) References Cited

U.S. PATENT DOCUMENTS 5,040,709 A * 8/1991 Neugent ..... B62J 11/04 224/431
5,042,770 A * 8/1991 Louthan ..... B60N 3/108 248/205.3
5,145,138 A * 9/1992 Schlanger ..... B62J 11/04 248/311.2
5,170,981 A * 12/1992 Lin ..... B62J 9/27 248/311.2
5,232,137 A * 8/1993 Devine ..... A45F 5/02 224/678
5,249,770 A * 10/1993 Louthan ..... A47K 1/09 248/230.8
5,301,860 A * 4/1994 Paczonay ..... B62J 11/04 224/427
D346,996 S * 5/1994 Blackburn ..... D12/411
5,474,273 A * 12/1995 Vinal ..... A47G 23/0225 248/156
5,537,719 A 7/1996 Freed
5,604,958 A 2/1997 Anscher
5,628,443 A 5/1997 Deutsch
5,697,587 A * 12/1997 Israel ..... B60N 3/103 248/302
5,927,581 A * 7/1999 Reddy ..... A45F 3/04 224/655
5,944,238 A * 8/1999 Stark ..... A47G 23/0225 220/751
5,971,119 A 10/1999 Chi
6,047,937 A * 4/2000 Huang ..... B60N 3/102 248/312.1
6,059,245 A * 5/2000 Hermansen ..... B62J 11/04 248/316.5
6,557,738 B1 * 5/2003 Meintzer ..... B44D 3/14 224/678
6,820,770 B2 * 11/2004 Makino ..... A47K 5/12 248/154
7,080,430 B2 7/2006 Wemmer
7,237,703 B1 7/2007 Nathan et al.
D557,653 S * 12/2007 Meggiolan ..... D12/411
7,533,860 B2 * 5/2009 Somuah ..... B60N 3/102 206/217
7,669,742 B2 * 3/2010 Rush ..... F41C 33/0236 248/316.1
7,959,121 B1 * 6/2011 Barnes, Jr. ..... A47G 23/0225 248/311.2
8,079,503 B1 12/2011 Yeates et al.
8,245,892 B2 * 8/2012 Kriner ..... A45F 5/02 224/183
8,500,076 B2 * 8/2013 Lai ..... B62B 9/26 248/102
8,584,917 B2 11/2013 Hexels
8,690,166 B2 * 4/2014 Peota ..... B62B 3/1472 220/482
9,386,866 B2 * 7/2016 Presenty ..... A47F 5/0846
9,394,025 B2 * 7/2016 Briney ..... B62J 11/04
9,758,080 B2 * 9/2017 Goldman ..... B60N 3/101
9,944,209 B1 * 4/2018 Carnevali ..... F16M 11/2028
9,975,492 B2 * 5/2018 Cardonna ..... F17C 13/084
10,131,393 B2 * 11/2018 Chuang ..... B62J 9/27
10,252,897 B2 4/2019 Thompson
10,499,723 B2 * 12/2019 Goldman ..... A45F 5/00
10,531,755 B1 * 1/2020 Huang ..... F16B 2/12
D877,664 S * 3/2020 Brockway ..... D12/133
10,588,812 B2 * 3/2020 Brockway ..... A61H 1/00
10,694,834 B2 6/2020 Logan et al.
11,324,306 B2 * 5/2022 Joye ..... A45F 5/021
11,952,066 B2 * 4/2024 Ycas ..... B62J 11/04
2004/0124218 A1 * 7/2004 Shivas ..... A45F 3/16 224/269
2004/0238577 A1 * 12/2004 Shivas ..... A45F 3/16 224/666
2004/0256428 A1 * 12/2004 Meggiolan ..... B62J 11/04 224/425
2007/0267454 A1 * 11/2007 Baiz ..... A45C 13/001 224/576
2010/0206919 A1 * 8/2010 Boyom ..... A45F 5/02 224/148.1
2014/0027477 A1 * 1/2014 deBeers ..... A45F 5/021 224/148.4
2015/0031007 A1 1/2015 Ruiz
2020/0165036 A1 5/2020 Squiers et al.

* cited by examiner

PACK-BASED HOLDER FOR BOTTLE OR OTHER ELONGATE OBJECT

FIELD

Embodiments herein relate generally to an apparatus for holding and accessing bottles or other similar objects, and in particular, a bottle holder that can be attached to another item, such as a backpack, to adequately secure the bottle and improve the ease of access to the bottle.

BACKGROUND

Many activities can benefit from storing and carrying a bottle containing water or another consumable liquid. Backpacks therefore will often include one or more bottle holders so that a user can store and carry a water bottle while engaging in various activities, such as hiking, traveling, or commuting to work. Typically, the bottle holder on a backpack comprises a side pocket where the bottle can be stored, or a clip that can be used to attach the bottle to the backpack. These designs may be inconvenient, as they often prompt removing the backpack and setting it down in order to access the bottle. These designs may also be inadequate to secure the bottle without it excessively moving and potentially falling out, given the variety in bottle sizes and designs.

Consequently, there is a need for a bottle holder that can be attached to another object, such as a backpack, that can both adequately secure the bottle, and improve the ease of access to the bottle.

SUMMARY

A pack-based holder may include a spine defining a longitudinal axis comprising a first end and a second end, a collar attached to the spine that reduces the movement of an object placed therein in a direction away from the longitudinal axis of the spine, and an arm movably coupled to the first end of the spine that can be moved between an open position and a closed position. When the arm is moved into the closed position, the arm restrains gravitational movement of the object, and when the arm is moved into the open position, the arm does not restrain gravitational movement of the object.

In some embodiments, the spine may include a first member and a second member, wherein the second member is slidably coupled to the first member to adjust the length of the spine. The spine may further include a locking member that fixes the position of the second member relative to the first member. Additionally, the spine may further include a spring that biases the second member toward a position along the longitudinal axis of the spine.

In some embodiments, the collar may be a tube that reduces the lateral movement of the object in all directions away from the longitudinal axis of the spine.

In further embodiments, the collar may include a first end, a second end, and a securing mechanism attached to the first end of the collar that is engageable with the second end of the collar to reduce the lateral movement of the object in all directions substantially perpendicular to the longitudinal axis of the spine. A portion of the collar may be curved to form an arc shape. The securing mechanism may be a latch. Alternatively, the securing mechanism may comprise a protrusion that is insertable in one or more adjustment holes spaced along a portion of the collar. The securing mechanism may also include a cord removably attached to the first end of the collar, and removably attached to the second end of the collar.

The collar may also be slidably coupled to the spine to adjust a position of the collar along the longitudinal axis of the spine. Additionally, the pack-based holder may further include a locking member that fixes the position of the collar along the longitudinal axis of the spine.

In some embodiments, the arm may be biased toward the closed position.

In some embodiments, the pack-based holder may further include a second arm movably coupled to the first end of the spine that can be moved between an open position and a closed position. When the second arm is moved into the closed position, the second arm reduces the movement of the object in a direction parallel to the longitudinal axis of the spine, and when the second arm is moved into the open position, the second arm does not reduce the movement of the object in a direction parallel to the longitudinal axis of the spine.

In some embodiments, the second arm may be biased toward the closed position.

A backpack may include a pack-based holder coupled thereto. The pack-based holder may include a spine defining a longitudinal axis comprising a first end and a second end, a collar attached to the spine that reduces the movement of an object placed therein in a direction away from the longitudinal axis of the spine, and an arm movably coupled to the first end of the spine that can be moved between an open position and a closed position. When the arm is moved into the closed position, the arm restrains gravitational movement of the object, and when the arm is moved into the open position, the arm does not restrain gravitational movement of the object. In some embodiments, the pack-based holder may further include a second arm movably coupled to the first end of the spine that can be moved between an open position and a closed position. When the second arm is moved into the closed position, the second arm reduces the movement of the object in a direction parallel to the longitudinal axis of the spine, and when the second arm is moved into the open position, the second arm does not reduce the movement of the object in a direction parallel to the longitudinal axis of the spine.

In some embodiments, the baseplate may be positioned on a portion of the backpack such that the arm is accessible to a person wearing the backpack. In other embodiments, movement of the arm from the closed position to the open position may be facilitated when the pack-based comes into contact with the arm.

DETAILED DESCRIPTION

Figure 1:
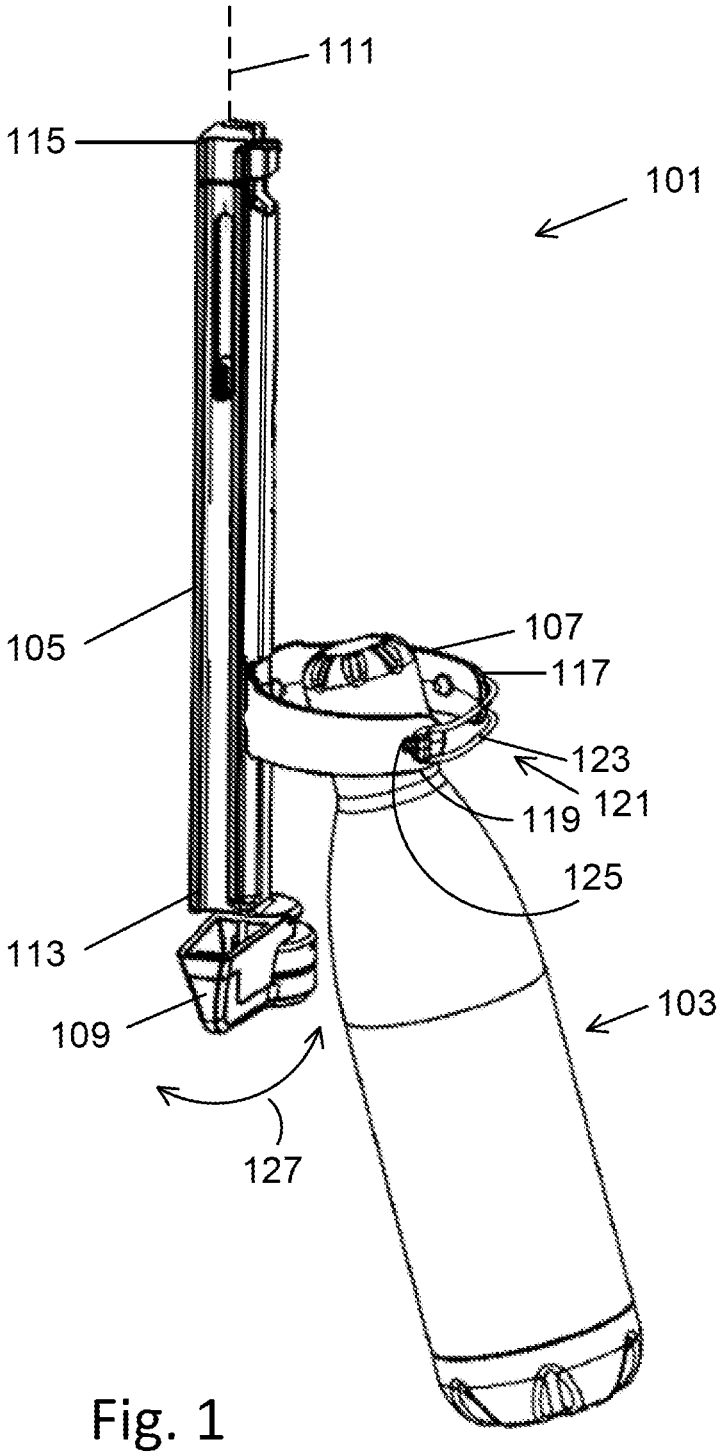
FIG. 1 illustrates a pack-based holder with some examples of components that may be included and/or that may interact with the pack-based holder in accordance with various embodiments.

FIG. 1 illustrates a holder 101 (e.g., a pack-based holder 101) with some examples of components that may be included and/or that may interact with the holder 101 in accordance with various embodiments. FIG. 1 also depicts an example of a bottle or other object 103 that may be utilized with the holder 101. The object 103 may correspond to any suitable water bottle or other vessel for retaining liquid, for example. The holder 101 is not limited to use with the particular bottle or object 103 depicted. For example, the holder 101 additionally or alternatively may be used with any of a variety of water bottles, flashlights, fire extinguisher, spray bottles, canisters, or other objects (e.g., elongate objects). Thus, it is to be understood that any reference to the bottle 103 herein may additionally or alternatively refer to an object 103 of a suitable size and shape to be releasably retained in use by the holder 101.

The holder 101 depicted in FIG. 1 is shown with a spine 105, a collar 107, and an arm 109, although more, fewer, and/or other components may be included. The spine 105 can define a longitudinal axis 111. The spine 105 can be formed of suitable material, e.g., such that other components may be supported by the spine 105 in use. The spine 105 can include a first end 113 (e.g., a spine first end) and a second end 115 (e.g., a spine second end), which may be located opposite one another at opposite extremes of the spine 105 and/or at suitable locations relative to which other components may be arranged, regardless of whether the spine 105 continues beyond the first end 113 and/or the second end 115.

The collar 107 can be attached to the spine 105. For example, the collar 107 may be positioned to extend from the spine 105 from a location on the spine 105 between the first end 113 and the second end 115. The collar 107 can include any suitable structure capable of reducing the movement of the bottle 103 placed therein in a direction away from the longitudinal axis 111 of the spine 105. For example, the collar 107 in FIG. 1 is formed as a tube that reduces lateral movement of the bottle 103 in all directions away from the longitudinal axis 111 of the spine 105. At least a portion of the collar 107 can be curves to form an arc shape.

The collar 107 can include multiple parts such that relative motion can be performed to adjust a size of the collar 107 and/or an area encompassed by the collar 107. For example, the collar 107 may be adjusted to accommodate different sizes of the bottle 103. The collar 107 may be adjustable to provide a snug fit against the bottle 103 in use when the bottle 103 is received by the holder 101. The collar 107 can include a first end 117 (e.g., a collar first end) and a second end 119 (e.g., a collar second end). The first end 117 and the second end 119 may be connected by an adjustable structure to permit the collar 107 to be adjustable in size. For example, as depicted in FIG. 1, the collar 107 can include a securing member 121 attached to the first end 117 of the collar 107. The securing member 121 may be engageable with the second end 119 of the collar 107 to reduce lateral movement of the bottle 103 in all directions substantially perpendicular to the longitudinal axis 111 of the spine 105. Although the securing member 121 is depicted in FIG. 1 as including a cord 123 that can be removably attached from one or both of the first end 117 and/or the second end 119 (such as by engagement or disengagement with one or more hooks 125), the securing member 121 can be or correspond to any other suitable structure, including, but not limited to, other structures described with respect to FIG. 3. In some embodiments, the securing member 121 may be include a cord 123 that can be formed of elastic material or that can otherwise exhibit a capacity to elongate and return toward an original size to provide a biasing force for urging the collar 107 into a snug configuration around the bottle 103 when the bottle 103 is received within the holder 101.

The arm 109 can be movably coupled to the first end 113 of the spine 105. The arm 109 may be movable between an open position and a closed position. In the open position, the arm 109 may be positioned to permit movement of the bottle 103 relative to the collar 107. For example, in the open position, the arm 109 may be out of the way of a path of the bottle 103 into or out of the collar 107 (such as depicted in FIG. 1). The arm 109 may be movable between the open position and the closed position by rotation (such as depicted by arrow 127), translation, and/or any other form of movement. In the closed position, the arm 109 may be arranged to restrain gravitational movement of the bottle 103. For example, the bottle 103 may rest atop the arm 109 in the closed position. In the open position, the arm 109 may be arranged so that the arm 109 does not restrain gravitational movement of the bottle 103. For example, in the open position, the bottle 103 may be free to move under the effect of gravity to exit the collar 107 in use. Additionally or alternatively in the open position, the bottle 103 may be free to the inserted upward relative the holder 101, such as into the collar 107 and/or relative other components shown and described with respect to FIG. 2.

Figure 2:
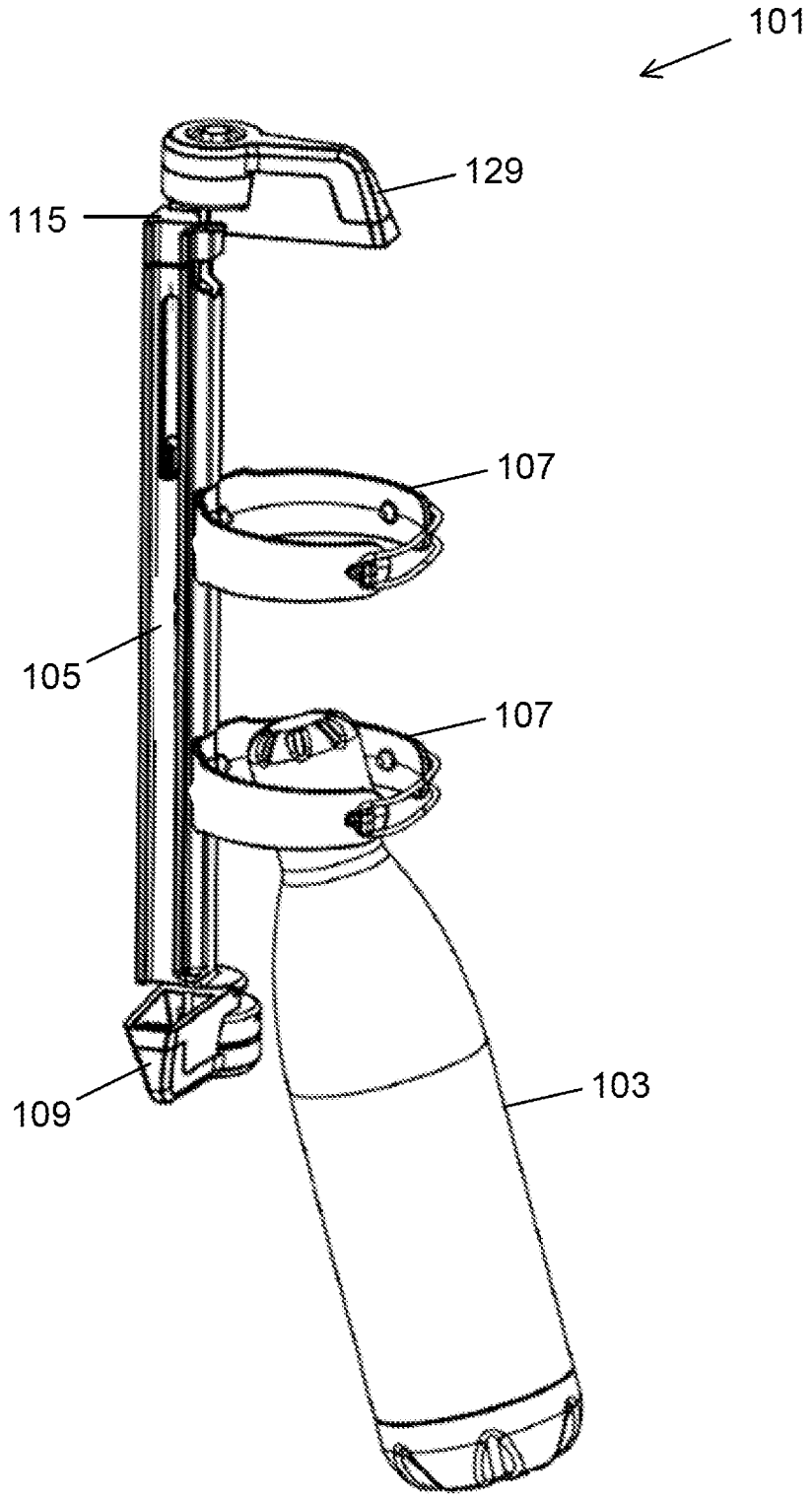
FIG. 2 illustrates the pack-based holder of FIG. 1 with additional components that may be included in accordance with various embodiments.

FIG. 2 illustrates the holder 101 with additional components that may be included. In FIG. 2, the bottle holder is shown with the spine 105, multiple collars 107, the arm 109 (which may be a first arm 109), and a second arm 129, although more, fewer, and/or other components may be utilized. For example, although two identical collars 107 are depicted, any number of like or different collars 107 may be implemented.

The second arm 129 may be coupled to the second end 115 of the spine 105. In use, the second arm 129 may provide a stop or limit against which the bottle 103 can engage when being inserted into the holder 101 from an underside (e.g., after the bottle 103 has been inserted and at least partially traveled through both of the collars 107). The second arm 129 may be movable, such as to facilitate access to the bottle 103 through a top of the holder 101 (e.g., such as described in greater detail with respect to FIG. 4). Inserting the bottle 103 into the holder 101 from underneath with the first arm 109 in the open position may allow the bottle 103 to be received and secured within the bottle holder, such as to reach a secured state, some examples of which are shown in FIG. 3.

Figure 3:
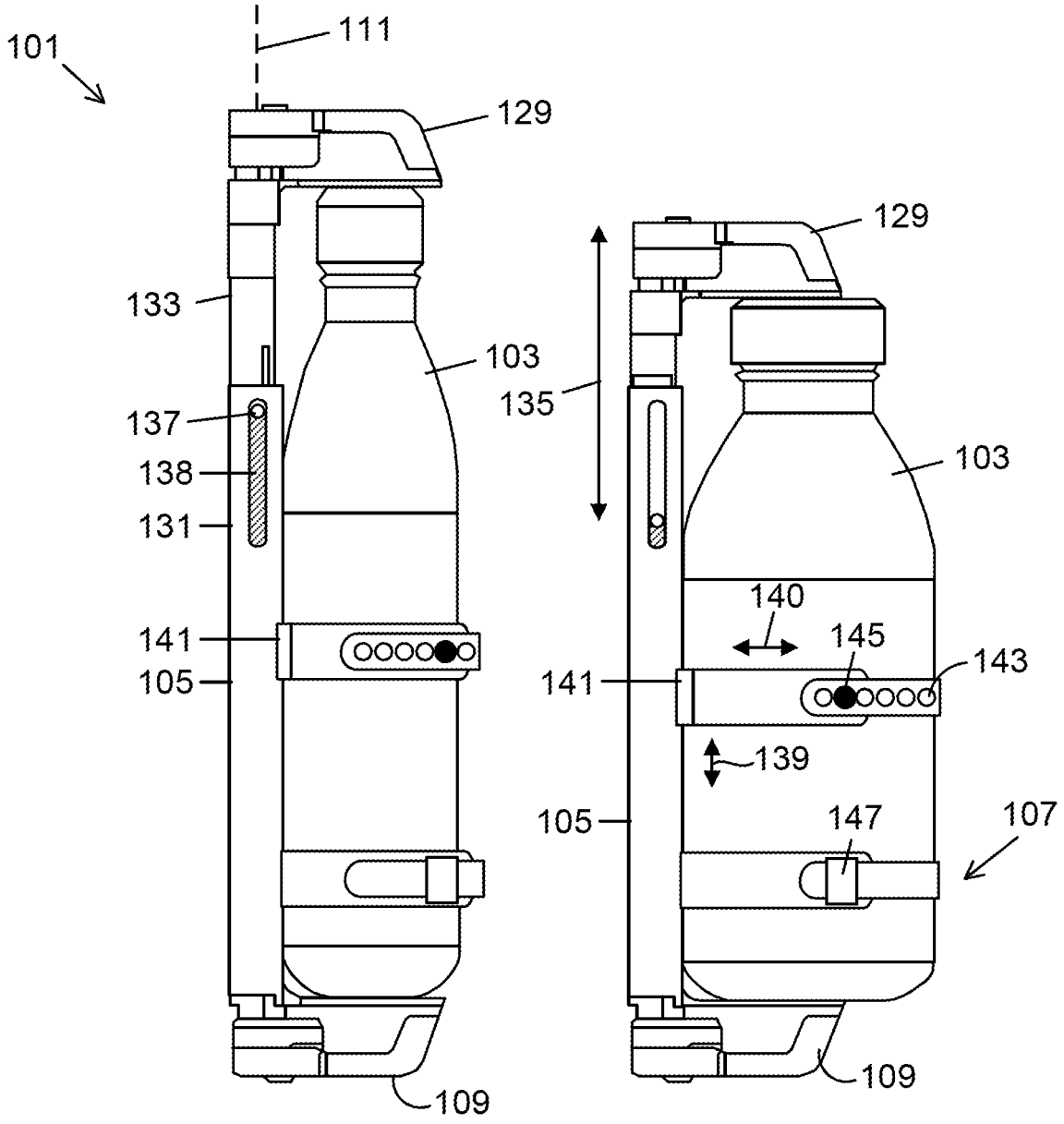
FIG. 3 illustrates the pack-based holder of FIG. 1 in some examples of a secured state in accordance with various embodiments.

FIG. 3 illustrates the holder 101 in some examples of a secured state. The bottle 103 may be secured by the holder 101. The first arm 109 can be arranged along an underside of the bottle 103, such as to support the bottle 103 from underneath and/or to restrain gravitational movement of the bottle 103. The second arm 129 can be arranged along a lid or top of the bottle 103, such as to provide a restraint against the bottle 103 moving upward. For example, the second arm 129 in the secured state may inhibit movement of the bottle 103 in a direction parallel to the longitudinal axis 111 of the spine 105.

Various elements of the holder 101 may be adjustable. Adjustability may allow the holder 101 to accommodate different sizes of bottles. For example, at left in FIG. 3, the holder 101 is shown holding a first bottle 103, and at right, the holder 101 is shown holding a second bottle 103' of a different height and girth.

In some embodiments, the spine 105 may be adjustable in length. For example, the spine 105 can include a first member 131 and a second member 133. The second member 133 may be slidable or slidably coupled to the first member 131, which may allow adjustment of the length of the spine 105 (such as depicted by arrow 135). The spine 105 can include a locking member 137 that fixes the position of the second member 133 relative to the first member 131. For example, the locking member 137 may correspond to a button that can be pushed to disengage teeth on the locking member 137 from a toothed surface within the spine 105 to permit relative movement between the first member 131 and the second member 133, although any other form of locking member 137 may be utilized. The spine 105 can further include a spring or other biasing member 138 that can bias the second member 133 toward a position along the longitudinal axis 111 of the spine 105. For example, the biasing member 138 may cause the second member 133 to extend upon actuation of the locking member 137, and pushing the second member 133 against the biasing action of the biasing member 138 may result in positioning at which the locking member 137 can re-engage to retain the holder 101 at a selected height.

In some embodiments, the collar 107 may be adjustable to change a position along the spine 105 (such as illustrated by arrow 139). For example, the collar 107 can be slidably coupled to the spine 105 to adjust the position of the collar 107 along the longitudinal axis 111 of the spine 105. A lock 141 (which may be similar to or different from the locking member 137) can be included, for example to fix the position of the collar 107 along the longitudinal axis 111 of the spine 105.

In some embodiments, the collar 107 may be expandable in a direction away from the longitudinal axis 111 of the spine 105 and/or otherwise adjustable to change an encompassing size or girth of the collar 107 (such as depicted by arrow 140). For example, as described previously with respect to FIG. 1, the collar 107 can include a cord 123 that may be capable of stretching to accommodate different sizes (such as the girth of one bottle 103 or a different girth of another bottle 103'). Two other examples of suitable adjustable structure of the collar 107 are shown in FIG. 3. The upper collar 107 is shown with a plurality of adjustment holes 143 spaced along a portion of the collar 107 and arranged for engagement with a protrusion 145 that is insertable into an individual adjustment hole 143 to secure at a given girth. The lower collar 107 is shown with a latch 147 that can receive a portion of the collar 107. Nonlimiting examples of such structures may include a ratcheting clasp similar to a binding on a snowboard boot, a pivotable clasp engageable for a friction fit, or any other form of clasp or releasable fastener. Moreover, although particular different forms of the collar 107 are shown in use together at upper and lower positions in FIG. 3, any like, different, or individual collars 107 can be utilized.

Figure 4:
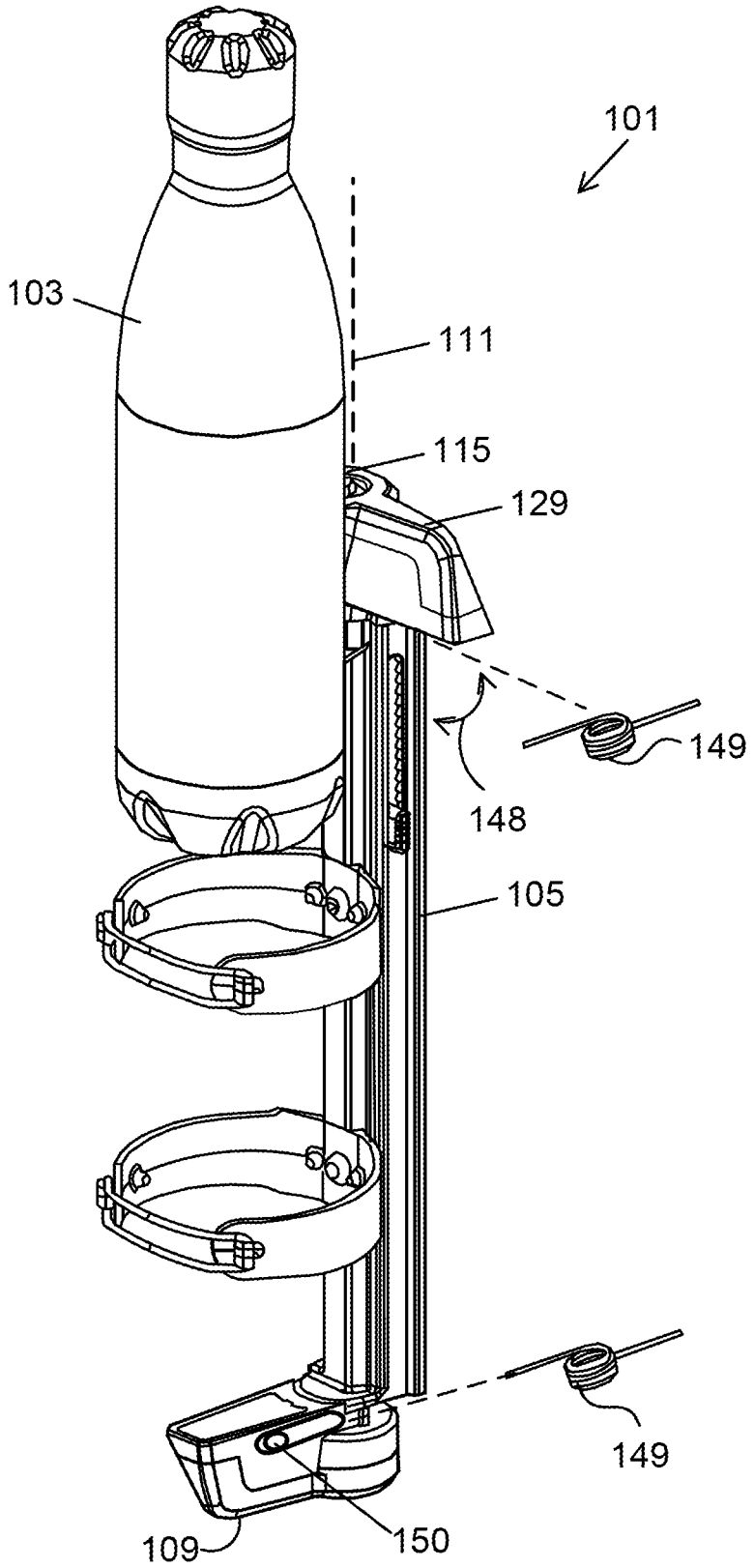
FIG. 4 illustrates the pack-based holder of FIG. 1 in a configuration to facilitate movement relative to an upper portion of the pack-based holder in accordance with various embodiments.

FIG. 4 illustrates the holder 101 in a configuration to facilitate movement relative to an upper portion of the holder 101. The second arm 129 may be movably coupled to the second end 115 of the spine 105. For example, the second arm 129 can be movable between an open position and a closed position. The arm 129 may be movable between the open position and the closed position by rotation (such as depicted by arrow 148), translation, and/or any other form of movement. In the closed position (such as shown in FIG. 3), the second arm 129 can inhibit movement of the bottle 103 in a direction parallel to the longitudinal axis 111 of the spine 105. In the open position (such as shown in FIG. 4), the second arm 129 can permit (or be arranged to not inhibit) movement of the bottle 103 in a direction parallel to the longitudinal axis 111 of the spine 105. Overall, from a secured state (such as shown in FIG. 3), the first arm 109 can be moved from the closed position to the open position to permit the bottle 103 to be removed through the bottom of the holder 101, and/or the second arm 129 can be moved from the closed position to the open position to permit the bottle 103 to be removed through the top of the holder 101. Conversely, when the holder 101 is vacant, the first arm 109 can be moved from the closed position to the open position to permit the bottle to be inserted through the bottom of the holder 101, and/or the second arm 129 can be moved from the closed position to the open position to permit the bottle 103 to be inserted through the top of the holder 101. Once the bottle 103 is within the holder 101 arranging both the first arm 109 and the second arm 129 can secure the water bottle 103 within the holder 101.

The first arm 109 and/or the second arm 129 can be biased toward the closed position. For example, in FIG. 4, a torsional spring 149 is shown in an exploded view outward from each of the first arm 109 and the second arm 129 and may provide suitable biasing motion when incorporated within the assembly, although any other suitable form of biasing may be utilized. Biasing toward the closed position may allow the holder 101 to be actuated by a user to facilitate removal of the bottle 103 from the holder 101 and may facilitate the holder 101 automatically shifting into a secured state upon the bottle 103 being pushed sufficiently into the holder 101 for the bottle 103 to no longer be applying pressure for overcoming the biasing force. A locking mechanism 150 (which may be similar to or different from the locking member 137 and/or the lock 141) may be included to secure in the closed position. As an illustrative example, in the depiction in FIG. 4, the locking mechanism 150 is shown as a thumb-slide type lock located on a side of the first arm 109 in a suitable position to be slidable to cause a protrusion to extend from within the first arm 109 to lodge into a mating notch in the spine 105 to prevent rotation of the first arm 109, although the locking mechanism 150 may be implemented with any other structure (e.g., other locking structure) or placement (e.g., on a top, bottom, side facing toward the wearer, or side facing away from the wearer). Although only one locking mechanism 150 is visible in the view in FIG. 4, either or both of the first arm 109 and the second arm 129 may include a respective locking mechanism 150 for securing in the closed position or releasing to permit movement to the open position, e.g., in opposition to biasing from the torsional spring 149. In some examples, the holder 101 (e.g., via the locking mechanism 150 and/or other structure) may provide an audible sound to indicate an upper portion of the object 103 is suitably positioned for insertion. For example, the first arm 109 may produce a clicking noise at initial engagement. In some examples, the holder 101 may be configured to permit disabling the audible sound. For example, a neutral position of the locking mechanism 150 may correspond to a disabled or off state for the audible sound, while toggling from the neutral position in one direction may engage for securing and toggling further or in another direction may enable an audible setting.

Figure 5:
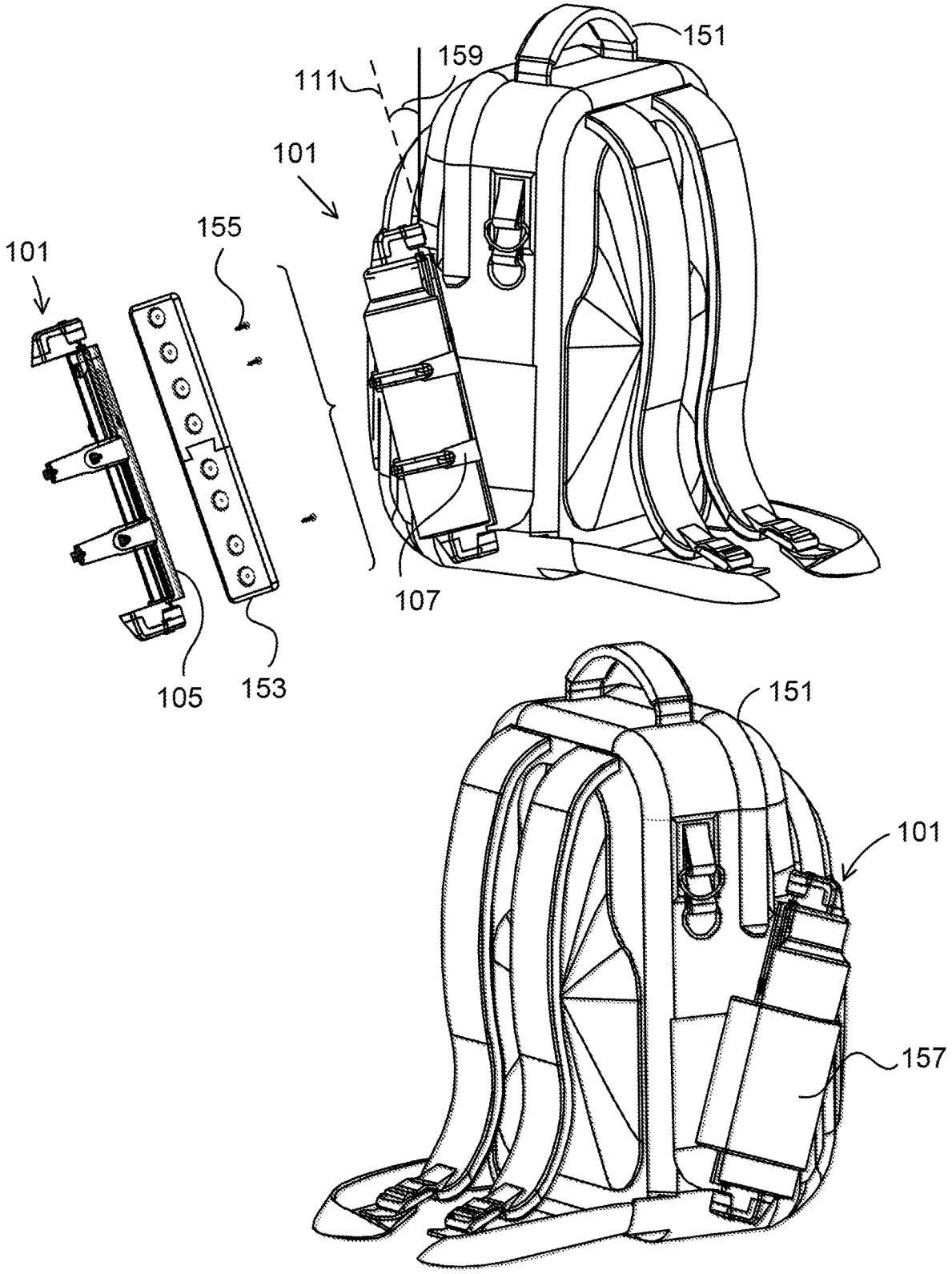
FIG. 5 shows views of a backpack that may feature the pack-based holder of FIG. 1 in use in accordance with various embodiments.

FIG. 5 shows views of a backpack 151 that may feature the holder 101 in use. Although the holder 101 is depicted installed relative to the backpack 151, the holder 101 additionally or alternatively may be suitable for installation and/or incorporation into backpacks, hiking packs, day packs, luggage, bicycles, vehicles, and/or other forms of gear and/or wearables. The upper and lower views in FIG. 5 may correspond to opposing sides of the same backpack 151 or may correspond to different instances of the backpack 151. The backpack 151 may include a bag with straps arranged for wearing the bag on a back of the wearer. As may be appreciated in the top view in FIG. 5, the holder 101 may include or be coupled with a base plate 153. For example, fasteners 155 may couple the base plate 153 to the spine 105. The base plate 153 and the spine 105 can be positioned on opposite sides of a layer of material of the backpack 151 when coupled together so as to mount the holder 101 to the backpack 151. The holder 101 may be releasably coupled with and/or installed as a retrofit assembly relative to the backpack 151 in this manner or any other suitable fashion. As may be appreciated in the lower view in FIG. 5, the holder 101 may be built into the backpack 151 as an original part of the backpack 151. In some embodiments (as may be best seen in the lower view in FIG. 5), the holder 101 may be accompanied by a sleeve 157 of fabric or other suitable material. The sleeve 157 may cover collars 107 from view and/or may function as another suitable form of collar in use.

The holder 101 may be positionable at a suitable angle 159 when installed on the backpack 151. For example, this may correspond to the holder 101 being rotatable about an axis substantially perpendicular to the longitudinal axis 111 of the spine 105. The angle 159 may be defined as a deviation of the longitudinal axis 111 from a vertical direction aligned with gravity. Position the bottle holder at a suitable angle 159 may facilitate accessibility of the holder 101 while the backpack 151 is worn by a user, such as described in greater detail with respect to FIG. 6.

Figure 6:
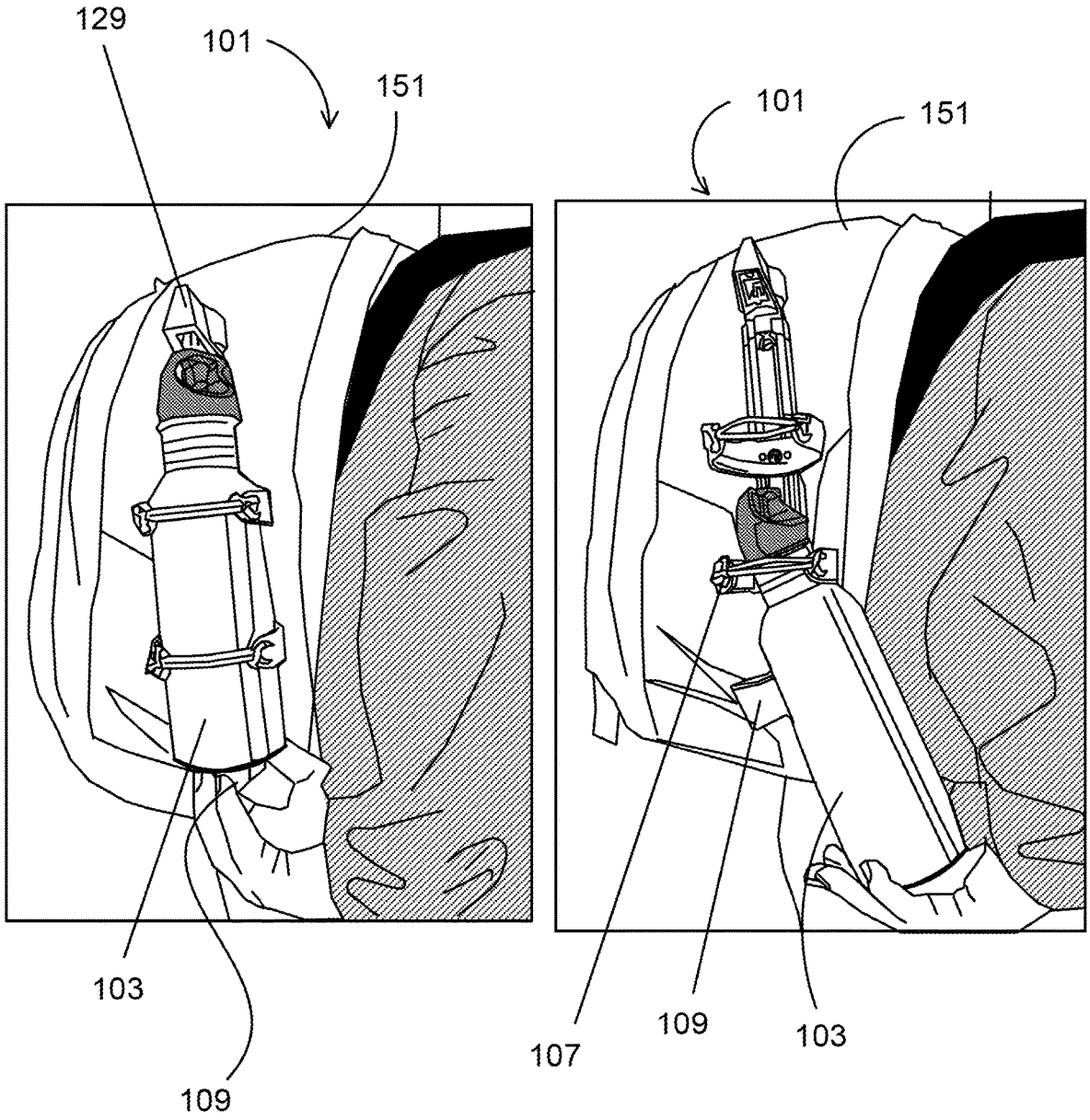
FIG. 6 illustrates examples of states of the pack-based holder of FIG. 1 during use by a wearer of a backpack bearing the pack-based holder in accordance with various embodiments.

FIG. 6 illustrates examples of states of the holder 101 during use by a wearer of a backpack 151 bearing the holder 101. In use, the holder 101 may be arranged such that the arm 109 is accessible to the wearer without the wearer doffing the backpack 151. For example, as may be best seen at left in FIG. 6, to retrieve the bottle 103, the wearer can reach a hand back and push the arm 109 (e.g., rearwardly). Pushing the arm 109 can move the arm 109 from underneath the bottle 103 and allow the bottom of the bottle 103 to be movable under the effect of gravity, e.g., such that the bottle 103 can exit out the bottom of the holder 101, such as into the hand of the wearer of the backpack 151 (e.g., into the position shown at right in FIG. 6).

When the bottle 103 is fully out of the holder 101 and the wearer of the backpack 151 is ready to store the bottle 103 (such as after taking a drink and/or refilling the bottle 103), the wearer of the backpack 151 may readily secure the bottle 103 in the holder 101 without removing the backpack 151. For example, as may best be seen at right in FIG. 6, the wearer of the backpack 151 may reach backward with the bottle 103 and push the bottle 103 upward into the holder 101 (e.g., while holding the bottom of the bottle 103). Pushing the bottle 103 upward may involve aligning at least a portion of the bottle 103 within collar 107 and/or aligning at least a portion of the bottle 103 in a suitable position to push against the arm 109 so that the arm 109 is deflected out of the way of the path of travel of the bottle 103 into the collar 107 and/or other portion of the holder 101. For example, movement of arm 109 from the closed position to the open position to facilitate introduction of the bottle 103 into the holder 101 may be facilitated when the bottle 103 moves toward the collar 107 and comes into contact with the arm 109. Upon pushing the bottle 103 sufficiently upward into the holder 101, the arm 109 may be moved (e.g., by automatic actuation of biasing of the arm 109 and/or manual manipulation provided by the wearer of the backpack 151) into position underneath the bottle 103 (which may correspond to the position shown at left in FIG. 6).

The holder 101 can also allow the bottle 103 to be removed and/or inserted through a top of the holder 101. The top arm 129 can be rotated to facilitate such operations. For example, if the wearer takes off the backpack 151 and/or if the backpack 151 is on the ground or other location at which access from above may be useful, then the top arm 129 can be actuated to allow the bottle 103 to be slipped in or out through the top end of the holder 101.

Figure 7:
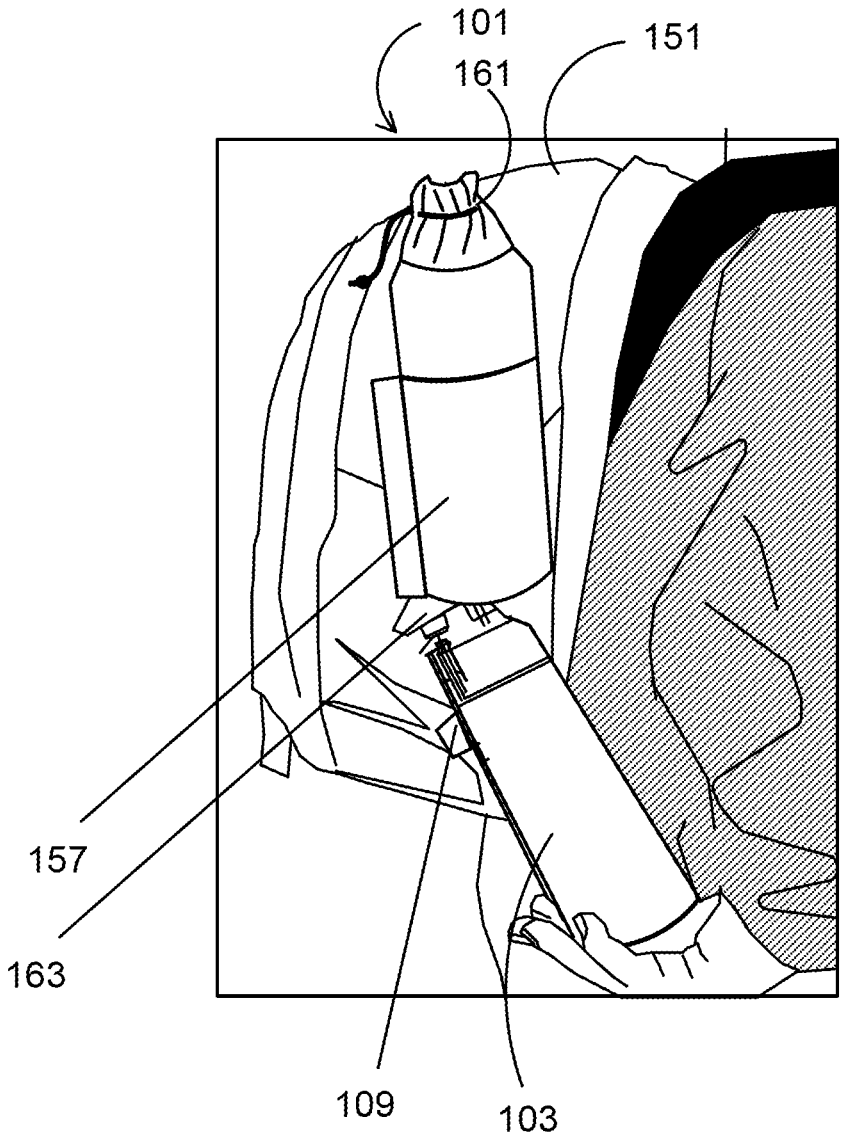
FIG. 7 shows a view of a backpack with further features that may be implemented relative to the pack-based holder of FIG. 1 in accordance with various embodiments.

FIG. 7 shows a view of a backpack 151 with further features that may be implemented relative to the holder 101. As previously noted, the holder 101 may be accompanied by a sleeve 157. The sleeve 157 at an upper portion may include a cinch-pocket entry 161. The cinch-pocket entry 161 may include a drawstring suitably routed and pullable to cinch an opening to a sufficiently small or closed state to provide an upper retaining structure for the object 103 within the holder 101. For example, the cinch-pocket entry 161 may be provided in addition to (e.g., to providing a covering over) or in lieu of the second arm 129.

A guide 163 may be included with the holder 101. For example, the guide 163 may correspond to a flared, ramped, and/or funnel-shaped surface. The guide 163 may be of similar or different material relative to the sleeve 157 and/or collar(s) 107 and generally may be formed to include any suitably rigid or robust material that can be contacted by and redirect the object 103 in use. The guide 163 may be sized and shaped to form a camming surface along which an upper part of the object 103 may ride or travel to be guided and/or directed into a central opening of the holder 101, such as into a main area of the sleeve 157 and/or the collar(s) 107. In use, the user when reaching backward with the object 103 may feel or notice when the object 103 has engaged the guide 163 and may find the guide 163 useful for directing the object 103 further into the holder 101 as the user continues to push the object 103 upward. For example, the guide 163 may function to provide a larger receiving area at which the object 103 may be installed in the holder 101 than if the holder 101 is provided without the guide 163. In operation, the object 103 may rest at least partially against the first arm 109 while being pushed toward the guide 163 and upon contact with the guide 163, the object 103 may be levered against the first arm 109 to direct a top of the object 103 along the guide 163 into the sleeve 157, collar(s) 107, and/or other structure of the holder 101. The guide 163 may extend at least partially along a circumference of the holder 101 the sleeve 157 and/or the collar(s) 107. The guide 163 may flare out and extend to form an arc, e.g., which may have a larger radius back to a central axis than a radius of the sleeve 157 and/or the collar(s) 107.

STATEMENTS REGARDING INCORPORATION BY REFERENCE AND VARIATIONS

In general the terms and phrases used herein have their art-recognized meaning, which can be found by reference to standard texts, journal references and contexts known to those skilled in the art.

All references throughout this application, for example patent documents, including issued or granted patents or equivalents and patent application publications, and non-patent literature documents or other source material are hereby incorporated by reference herein in their entireties, as though individually incorporated by reference.

All patents and publications mentioned in the specification are indicative of the levels of skill of those skilled in the art to which the invention pertains. References cited herein are incorporated by reference herein in their entirety to indicate the state of the art, in some cases as of their filing date, and it is intended that this information can be employed herein, if needed, to exclude (for example, to disclaim) specific embodiments that are in the prior art.

When a group of substituents is disclosed herein, it is understood that all individual members of those groups and all subgroups and classes that can be formed using the substituents are disclosed separately. When a Markush group or other grouping is used herein, all individual members of the group and all combinations and subcombinations possible of the group are intended to be individually included in the disclosure. As used herein, "and/or" means that one, all, or any combination of items in a list separated by "and/or" are included in the list; for example "1, 2 and/or 3" is equivalent to "1, 2, 3, 1 and 2, 1 and 3, 2 and 3, or 1, 2 and 3".

Every formulation or combination of components described or exemplified can be used to practice the invention, unless otherwise stated. Specific names of materials are intended to be exemplary, as it is known that one of ordinary skill in the art can name the same material differently. It will be appreciated that methods, device elements, starting materials, and synthetic methods other than those specifically exemplified can be employed in the practice of the invention without resort to undue experimentation. All art-known functional equivalents, of any such methods, device elements, starting materials, and synthetic methods are intended to be included in this invention. Whenever a range is given in the specification, for example, a temperature range, a time range, or a composition range, all intermediate ranges and subranges, as well as all individual values included in the ranges given are intended to be included in the disclosure.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition, in a description of a method, or in a description of elements of a device, is understood to encompass those compositions, methods, or devices consisting essentially of and consisting of the recited components or elements, optionally in addition to other components or elements. The invention illustratively described herein suitably may be practiced in the absence of any element, elements, limitation, or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A pack-based holder, comprising:
a spine defining a longitudinal axis, the spine comprising:
a first end; and
a second end;
a collar attached to the spine, wherein:
the collar reduces movement of an object placed therein in a direction away from the longitudinal axis of the spine; and
an arm movably coupled to the first end of the spine, the arm being movable between an open position and a closed position, wherein:
in the closed position, the arm restrains gravitational movement of the object;
in the open position, the arm does not restrain gravitational movement of the object; and
wherein the arm is movable from underneath the object in the closed position to the open position to allow the object to exit out a bottom of the holder by gravitational movement.

2. The pack-based holder of claim 1, wherein:
the spine is rotatable about an axis perpendicular to the longitudinal axis of the spine.

3. The pack-based holder of claim 1, wherein:
the spine further comprises:
a first member;
a second member, wherein:
the second member is slidably coupled to the first member to adjust a length of the spine; and
a locking member that fixes a position of the second member relative to the first member.

4. The pack-based holder of claim 3, wherein:
the spine further comprises:
a spring that biases the second member toward a position along the longitudinal axis of the spine.

5. The pack-based holder of claim 1, wherein:
the collar further comprises:
a tube that reduces lateral movement of the object in all directions away from the longitudinal axis of the spine.

6. The pack-based holder of claim 1, wherein:
the collar further comprises:
a first end;
a second end; and
a securing member attached to the first end of the collar, wherein:
the securing member is engageable with the second end of the collar to reduce lateral movement of the object in all directions perpendicular to the longitudinal axis of the spine.

7. The pack-based holder of claim 6, wherein:
the securing member further comprises a latch.

8. The pack-based holder of claim 6, wherein:
the collar further comprises:
a plurality of adjustment holes spaced along a portion of the collar; and
the securing member further comprises:
a protrusion that is insertable in an adjustment hole.

9. The pack-based holder of claim 6, wherein:
the securing member further comprises:

a cord removably attached to the first end of the collar, and removably attached to the second end of the collar.

10. The pack-based holder of claim 1, wherein:

the collar is slidably coupled to the spine to adjust a position of the collar along the longitudinal axis of the spine; and the pack-based holder further comprises:

a locking member that fixes the position of the collar along the longitudinal axis of the spine.

11. The pack-based holder of claim 1, wherein:

the collar is expandable in a direction away from the longitudinal axis of the spine.

12. The pack-based holder of claim 1, wherein:

at least a portion of the collar is curved to form an arc shape.

13. The pack-based holder of claim 1, wherein:

the arm is biased toward the closed position.

14. The pack-based holder of claim 1, further comprising:

a second arm movably coupled to the second end of the spine, the second arm being movable between an open position and a closed position, wherein:

in the closed position, the second arm inhibits the movement of the object in a direction parallel to the longitudinal axis of the spine; and in the open position, the second arm does not inhibit the movement of the object in a direction parallel to the longitudinal axis of the spine.

15. The pack-based holder of claim 14, wherein:

the second arm is biased toward the closed position.

16. A backpack comprising:

a bag; and a pack-based holder coupled to the bag, the pack-based holder comprising:

a spine defining a longitudinal axis, the spine comprising:

a first end; and a second end;

a collar attached to the spine, wherein:

the collar reduces movement of an object placed therein in a direction away from the longitudinal axis of the spine; and an arm movably coupled to the first end of the spine, the arm being movable between an open position and a closed position, wherein:

in the closed position, the arm restrains gravitational movement of the object;

in the open position, the arm does not restrain gravitational movement of the object; and wherein the arm is movable from underneath the object in the closed position to the open position to allow the object to exit out a bottom of the holder by gravitational movement.

17. The backpack of claim 16, further comprising a baseplate removably coupled to the backpack, wherein the pack-based holder is coupled to the baseplate.

18. The backpack of claim 16, wherein:

the pack-based holder further comprises:

a second arm movably coupled to the second end of the spine, the second arm being movable between an open position and a closed position, wherein:

in the closed position, the second arm reduces the movement of the object in a direction parallel to the longitudinal axis of the spine; and in the open position, the second arm does not reduce the movement of the object in a direction parallel to the longitudinal axis of the spine.

19. The backpack of claim 16, wherein:

the pack-based holder is positioned on a portion of the backpack such that the arm is accessible to a person wearing the backpack without doffing the backpack.

20. The backpack of claim 16, wherein:

movement of the arm from the closed position to the open position is facilitated when the object moves toward the collar and comes into contact with the arm.

* * * * *